US009763847B2

(12) United States Patent
Yamamoto et al.

(10) Patent No.: US 9,763,847 B2
(45) **Date of Patent: *Sep. 19, 2017**

(54) WALKING MOVEMENT AID

(71) Applicants: KYUSHU UNIVERSITY, NATIONAL UNIVERSITY CORPORATION, Fukuoka (JP); TOKAI RUBBER INDUSTRIES, LTD., Aichi (JP)

(72) Inventors: Motoji Yamamoto, Fukuoka (JP); Shin-ichiro Takasugi, Fukuoka (JP); Yukihide Iwamoto, Fukuoka (JP); Masanori Sato, Fukuoka (JP); Kazunobu Hashimoto, Aichi (JP)

(73) Assignees: KYUSHU UNIVERSITY, NATIONAL UNIVERSITY CORPORATION, Fukuoka (JP); SUMITOMO RIKO COMPANY LIMITED, Aichi (JP)

( * ) Notice: Subject to any disclaimer, the term of this patent is extended or adjusted under 35 U.S.C. 154(b) by 456 days.

This patent is subject to a terminal disclaimer.

(21) Appl. No.: 14/305,445

(22) Filed: Jun. 16, 2014

(65) Prior Publication Data

US 2014/0296761 A1 Oct. 2, 2014

Related U.S. Application Data

(63) Continuation of application No. PCT/JP2013/002156, filed on Mar. 29, 2013.

(30) Foreign Application Priority Data

Mar. 30, 2012 (JP) ..... 2012-082388

(51) Int. Cl.
*A61H 3/00* (2006.01)
*A61H 1/02* (2006.01)
(Continued)

(52) U.S. Cl.
CPC ..... *A61H 3/00* (2013.01); *A61H 1/0244* (2013.01); *A63B 21/0058* (2013.01);
(Continued)

(58) Field of Classification Search
CPC ..... A61H 1/02; A61H 1/0237; A61H 1/024; A61H 1/0244; A61H 2001/0248;
(Continued)

(56) References Cited

U.S. PATENT DOCUMENTS 5,154,690 A * 10/1992 Shiono ..... A61F 5/0102 602/21
7,563,393 B2 7/2009 Hayakawa et al.
(Continued)

FOREIGN PATENT DOCUMENTS

EP 2832338 2/2015
JP 2007-000391 1/2007
(Continued)

OTHER PUBLICATIONS

Search Report issued by E.P.O. patent office in E.P.O. Patent Application No. 13770071.2, dated Oct. 16, 2015.
(Continued)

*Primary Examiner* — Steven Douglas
(74) *Attorney, Agent, or Firm* — Greenblum & Bernstein, P.L.C.

(57) ABSTRACT

Provided is a joint movement aid, which has a simple structure and is lightweight and which a user can easily put on and take off, and which has a novel structure capable of safely supporting a walking without impeding a user's autonomous fall-preventing movement even in a case of a disturbance such as external force on the user in a transverse direction. The walking movement aid includes a right and left pair of assisting units provided with drive sources, which exert a pulling force on flexible auxiliary force transmission
(Continued)

parts, and a control member for controlling the respective drive sources of the assisting units corresponding to changes in a joint angle with user's hip joints.

6 Claims, 12 Drawing Sheets

(51) Int. Cl.
*A63B 21/005* (2006.01)
*A63B 23/04* (2006.01)
*A63B 21/00* (2006.01)

(52) U.S. Cl.
CPC .. *A63B 21/00178* (2013.01); *A63B 21/00181* (2013.01); *A63B 21/4009* (2015.10); *A63B 21/4011* (2015.10); *A63B 21/4025* (2015.10); *A63B 21/4043* (2015.10); *A63B 23/0482* (2013.01); *A61H 2003/007* (2013.01); *A61H 2201/1215* (2013.01); *A61H 2201/1261* (2013.01); *A61H 2201/163* (2013.01); *A61H 2201/165* (2013.01); *A61H 2201/1642* (2013.01); *A61H 2201/1676* (2013.01); *A61H 2201/5007* (2013.01); *A61H 2201/5069* (2013.01); *A63B 2209/10* (2013.01); *A63B 2220/16* (2013.01)

(58) Field of Classification Search
CPC ..... A61H 2001/0251; A61H 1/0262; A61H 3/00; A61H 2201/16; A61H 2201/1628; A61H 2201/163; A61H 2201/1666; A61H 2201/1673; A61H 2201/50; A61H 2201/5069; A61H 2203/00; A61H 2203/04; A61H 2203/0406
See application file for complete search history.

(56) References Cited

U.S. PATENT DOCUMENTS

| | | | | |
|---|---|---|---|---|
| 7,958,789 | B2 | 6/2011 | Hayakawa et al. | |
| 8,083,644 | B2 * | 12/2011 | Purdy | A63B 21/0004 2/905 |
| 8,451,011 | B2 | 5/2013 | Hayakawa et al. | |
| 2008/0234608 | A1 | 9/2008 | Sankai | |
| 2010/0004577 | A1 | 1/2010 | Yasuhara et al. | |
| 2010/0049333 | A1 | 2/2010 | Endo et al. | |
| 2011/0218466 | A1 | 9/2011 | Takahashi et al. | |
| 2012/0095379 | A1 * | 4/2012 | Hama | A61F 5/028 602/23 |

FOREIGN PATENT DOCUMENTS

| | | |
|---|---|---|
| JP | 4200492 | 12/2008 |
| JP | 2010-42069 | 2/2010 |
| JP | 2010-75658 | 4/2010 |
| JP | 2010-110464 | 5/2010 |
| JP | 2011-229704 | 11/2011 |
| WO | 2014/109799 | 7/2014 |

OTHER PUBLICATIONS

English Language Translation of Written Opinion of International Searching Authority for PCT/JP2015/068532, mailed Jun. 24, 2016.
ISR for PCT/JP2013/002156, May 7, 2013.
Chinese Office Action mailed May 6, 2015 in Chinese Patent Application No. 201380005666.X along with an English translation thereof.
Search Report issued in EPO Patent Application No. 15836863.9, dated Sep. 5, 2016.
International Preliminary Report on Patentability for PCT/JP2013/002156, mailed Oct. 9, 2014.
Office Action issued in China Counterpart Patent Appl. No. 201580003236.3, dated Dec. 30, 2016 , along with an English translation thereof.
English language translation of IPRP in Patent Application No. PCT/JP2015/068532, dated Mar. 9, 2017.
European Patent Office Official Action received in Application No. 13 770 071.2, dated Jun. 27, 2017.

* cited by examiner

CALCULATION OF LENGTH OF AUXILIARY FORCE TRANSMISSION BAND(AC)

$$AC = \sqrt{AB^2 + BC^2 - 2AB \cdot BC \cos\left(\pi - \tan^{-1}\frac{OA}{OB} - \theta\right)}$$

CONFIRMATION OF EMG WAVEFORM OF CALF MUSCLES

RESULT : MUSCLE ELECTRIC POTENTIAL IN AREA OF 20 TO 40% OF WALKING CYCLE DECREASED

WALKING MOVEMENT AID

INCORPORATED BY REFERENCE

The disclosure of Japanese Patent Application No. 2012-082388 filed on Mar. 30, 2012 including the specification, drawings and abstract is incorporated herein by reference in its entirety. This is a Continuation of International Application No. PCT/JP2013/002156 filed on Mar. 29, 2013.

BACKGROUND OF THE INVENTION

1. Field of the Invention

This invention relates to a walking movement aid with a novel structure that enables a safe support of walking by allowing the fall-preventing effect of the user's autonomous reaction, even in the case, for example, of a disturbance on the user, such as an external force in the transverse direction, by supporting the user's muscular strength during the walking, but without excessively restricting the movement of the user who is wearing it.

2. Description of the Related Art

Conventionally, for example as stated in U.S. Publication No. US 2008/0234608 and U.S. Publication No. US 2011/0218466 and the like, a wearable assist device is proposed in order to support walking, etc., of a physically disabled person who has lost muscular strength or an elderly person whose muscular strength has weakened.

Incidentally, the assist device of a conventional structure that was indicated in these US 2008/0234608 and US 2011/0218466 is an external skeleton type assist device, wherein the external skeleton, which is composed of a rigid arm and frame that is worn to fit the user's body, is driven at the joints by motors in order to move the user's legs in combination with the external skeleton's arms.

However, in that type of assist device that employs a rigid external skeleton, if it did not fit the user's physique properly or it was not worn properly, there was a risk of excessive force being applied to the user's joint, etc., during movement.

And, since the rigid external skeleton restricts the movement of the user's joints, there was also the possibility of the fall-preventing effect of the user's autonomous reaction being hindered, and leading to a fall in the case that, for example, there is a disturbance on the user, such as an external force in the transverse direction.

In addition, Japanese Unexamined Patent Publication No. JP-A-2010-042069 proposed assist control which provides sensors that individually measure the ground reaction force that acts on the user's right and left legs and thus detects the load balance at the front-back and left-right of both legs, thereby recovering balance when the front-back or left-right load balance collapsed.

However, with that kind of assist control, a large number of sensors and a system that can control and drive without time lag are required, and it is unavoidable for the structure of the assist device to become quite complicated. Furthermore, since it is necessary to take the user's muscular strength into consideration in cases where the user's muscular strength autonomously responds to a disturbance, it is unavoidable for the driving force control to become even more complicated and difficult. Moreover, since the assist device remains that which employs an external skeleton, it is also unavoidable that there is a possibility that the user's joints may be subject to excessive force that is caused, for example, by a slippage due to a disturbance when the device is worn.

SUMMARY OF THE INVENTION

The present invention was established in view of the above background, and the problem to be solved is to provide a walking movement aid with a novel structure that, in addition to having a simple construction that makes manufacturing easy, can safely and effectively demonstrate a muscular strength training effect by supporting the user's muscular strength during walking, but without excessively restricting the movement of the user who is wearing it.

A first mode of the present invention provides a walking movement aid comprising: a left and right pair of assisting units, each of the assisting units including an auxiliary force transmission part having flexibility, a first wearing part configured to be worn on a thigh side with respect to a user's hip joint, a second wearing part configured to be worn on a lumbar side with respect to the user's hip joint, and a drive source for applying a pulling force to the auxiliary force transmission part, the first wearing part and the second wearing part are disposed at opposite end parts of the auxiliary force transmission part; a joint angle sensor for detecting a joint angle of a front-back direction of the user's hip joints; a memory member for storing control information relating to drive timing information and drive output information for driving each drive source with the left and right pair of assisting units corresponding to changes in the joint angle with the user's hip joints; and a control member for performing drive control of each drive source with the left and right pair of assisting units based on the control information of the memory member.

In the walking movement aids made with a structure according to the first mode, by making the auxiliary force transmission parts flexible and allowing deformation, the user can more easily put on and take off the device in comparison with the walking movement aids that have a rigid external skeleton. Moreover, by allowing the user's autonomous movement, even while being worn, through deformation of the flexible auxiliary force transmission parts, the device does not excessively restrict the movement of the user like the walking movement aid with the conventional external skeleton type structure does. Therefore, a muscular strength training effect is demonstrated much more effectively through the user's autonomous movement and, for example, even if the user experiences a disturbance, such as an external force in the transverse direction, the fall-preventing movement of the user's autonomous reaction is allowed.

Therefore, with the walking movement aid related to the present invention, a state of walking is realized in which the muscular movement by the user's autonomous nervous system is effectively utilized, thus supporting muscular strength during the walking. As a result, efficient walking movement assistance can be realized for patients whose muscular strength has declined but do not attain a degree that requires weight bearing by the external skeleton etc., and a very excellent training effect can be safely demonstrated for early stage locomotive syndrome caused by a movement disorder.

Also, by allowing the user's autonomous movement based on the flexibility of the auxiliary force transmission parts, a sense of restriction to the user is mitigated, thus achieving an improvement in comfort in comparison with the external skeleton type of the walking movement aid.

Thus, the physical and mental load placed on the user from wearing the walking movement aid is reduced and it also becomes possible to wear it continuously over a long period of time.

A second mode of this invention provides the walking movement aid according to the first mode, wherein drive control signals by the control member are output independently from each other to the respective drive sources with the left and right pair of assisting units.

In the walking movement aid of this mode, the independent control of the drive sources on the left and right pair of assisting units makes it possible to control those drive sources more simply and with greater flexibility in comparison with when both of those assisting units are interrelatedly controlled. Response control to cases where there is a disturbance like an unexpected external force effect can also be performed even more easily and quickly in comparison with when they are interrelatedly controlled.

A third mode of this invention provides the walking movement aid according to the first or second mode, wherein the drive output information of the memory member comprises information that changes an output of the drive source corresponding to the changes in the joint angle.

In the walking movement aid of this mode, the support force from the left and right pair of assisting units on the left-right pair of legs is controlled with the change in the angles of the hip joints that changes in relation to the movement of the left and right legs as well as to muscular movement during walking movement used as the reference signal. Therefore, it becomes possible to achieve appropriate control in response to walking movement with a small number of sensors and a simple control system.

A fourth mode of this invention provides the walking movement aid according to any one of the first to third modes, wherein the memory member stores bending prevention control information to follow an effective length of the auxiliary force transmission part of the left and right pair of assisting units corresponding to changes in the joint angle of the user's hip joints, and the control member performs drive control of the respective drive sources of the left and right pair of assisting units so as to change the effective length and keep a fixed tensile force action state of the auxiliary force transmission part corresponding to changes in the joint angle based on the bending prevention control information stored in the memory member.

In the walking movement aid of this mode, because the generation of bending of the auxiliary force transmission parts accompanying the change in the hip joints is mitigated or avoided, the walking support force that acts on the legs from the auxiliary force transmission parts can be effectively, without a large time lag, and appropriately provided to the user.

A fifth mode of this invention is the walking movement aid according to any one of the first to fourth modes, wherein the joint angle sensor comprises a sensor made to detect an incline angle in the front-back direction of a femur in relation to a hip bone of the user individually for the left and right leg.

In the walking movement aid of this mode, it becomes possible to deliver a support force to each leg individually according to the angles of hip joints. Thus, for example, it also becomes possible to deliver a support force immediately to the leg that steps forward when walking is initiated. Furthermore, even when a large support force is suddenly needed for only one leg due to a disturbance, etc., it becomes possible to demonstrate that support force even more quickly.

A sixth mode of this invention is the walking movement aid according to any one of the first to fifth modes, wherein at least a portion of the auxiliary force transmission part is elastically deformable in a direction of exertion of the pulling force by the drive source.

In the walking movement aid of this mode, the pulling force that is delivered by the drive sources is eased by the elasticity of the auxiliary force transmission parts between the first wearing parts and the second wearing parts. Therefore, an excessive load and abrupt load on the user's joints, etc., is avoided and much greater safety for the user can be achieved.

With this invention, a rigid external skeleton becomes unnecessary, and the simple structure makes manufacturing easy. It is also possible to provide a walking movement aid with a novel structure that supports muscular strength during user's walking, but without excessively restricting the movement of the user, to allow the user's autonomous fall-preventing movement, etc., when, for example, there is a disturbance, etc., and safely and effectively demonstrate a training effect for muscular strength.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein.

DETAILED DESCRIPTION OF PREFERRED EMBODIMENTS

The following describes an embodiment of this invention with reference to the drawings.

Figure 1:
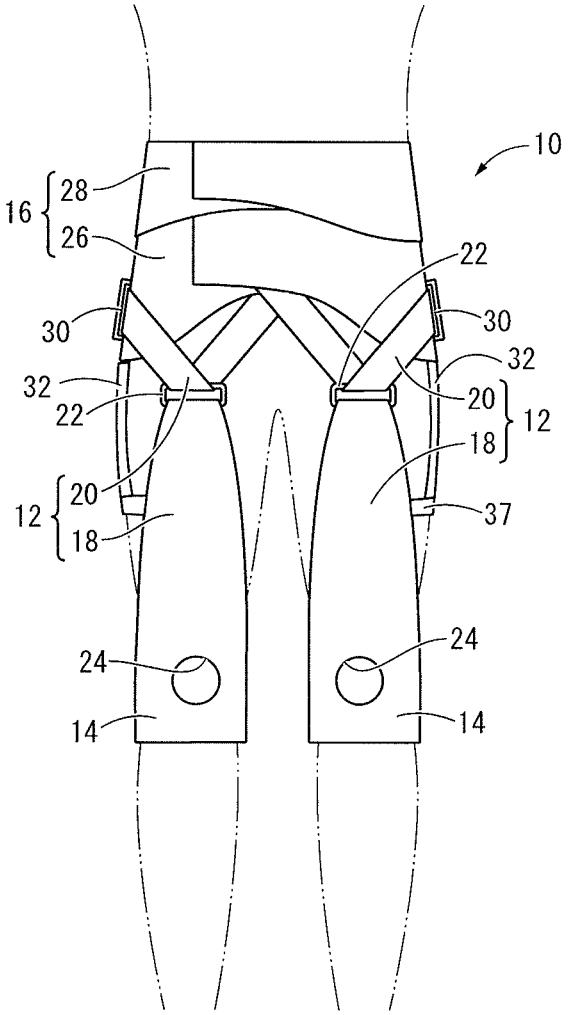
FIG. 1 is a front view of a walking movement aid as a first embodiment of this invention.
Figure 2:
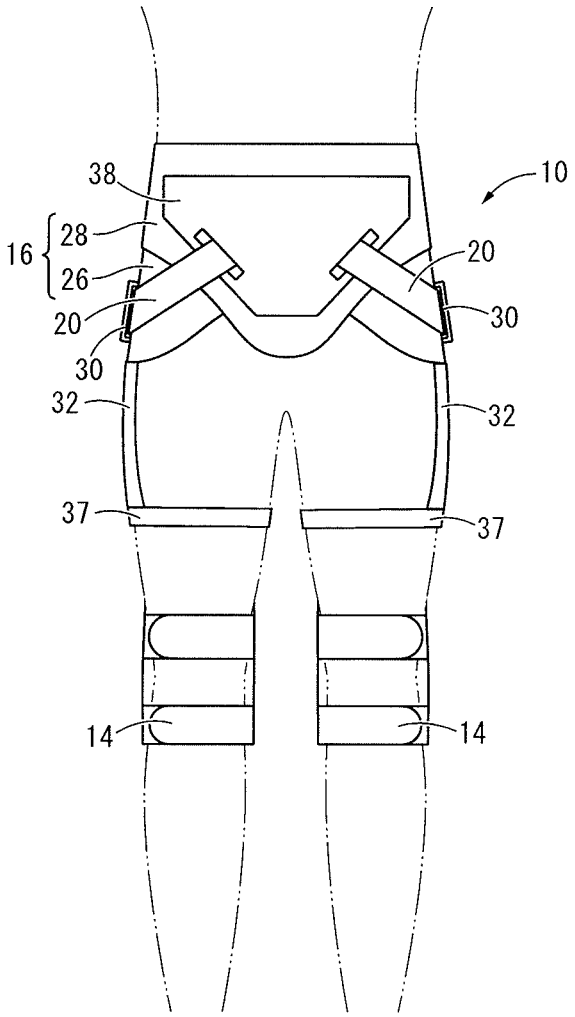
FIG. 2 is a rear view of the walking movement aid shown in FIG. 1.
Figure 3:
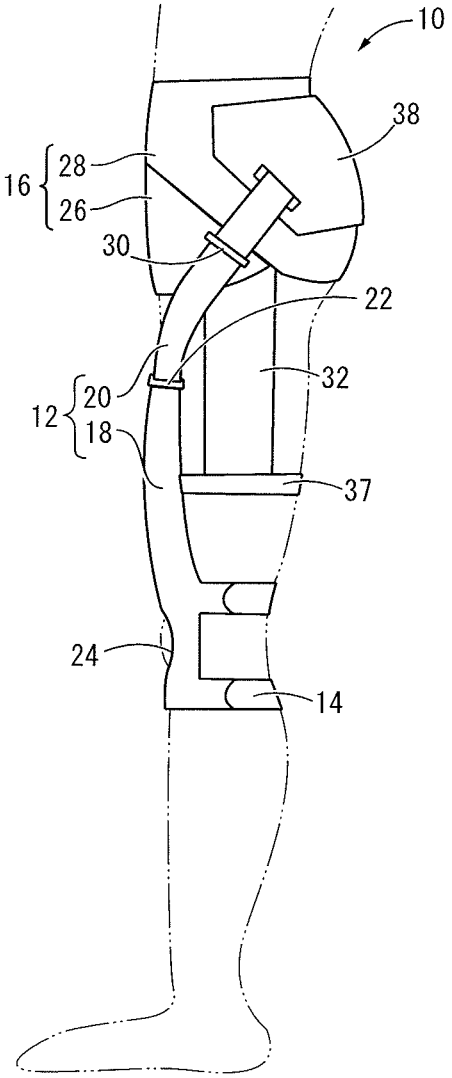
FIG. 3 is a side view of the walking movement aid shown in FIG. 1.

As a first embodiment of this invention, FIGS. 1 to 3 show a walking movement aid 10. The walking movement aid 10 assists bending and stretching of the hip joints and has a structure wherein the first wearing part 14 is provided on one end of each of the auxiliary force transmission bands 12 as a left and right pair of the auxiliary force transmission parts that extend across the hip joints and is attached on the thigh side where the femur is located, and the second wearing part 16 is provided and shared at the other ends of each of the left and right pair of the auxiliary force transmission bands 12 and is attached on the lumbar side where the hip bone is located. The left and right pair of assisting units is composed of these left and right pair of the auxiliary force transmission bands 12, each first wearing part 14, the shared the second wearing part 16, and electric motors 40 as a pair of drive sources (described later). FIGS. 1 to 3 illustrate the walking movement aid 10 as when it is worn by the user, and the user's outline is indicated with a two-dot chain line. Furthermore, in the following explanation, in principle, "front" refers to the side of the user's abdomen (front side), "back" refers to the side of the user's back (rear side), and "up-down" refers to the vertical direction, which is up and down in FIG. 1. Also, in the following explanation, "assistance force" refers to the auxiliary force that acts in the direction supplementing the strength force required for such movement as walking, while "resistance force" refers to the auxiliary force that acts in the direction of resistance on the strength force required for movement.

In more detail, the auxiliary force transmission bands 12 have a structure wherein the first traction bands 18 and the second traction bands 20, each formed of fabric, are connected by metal connecting fittings 22. The portions composed by of these first traction bands 18 and the second traction bands 20 are all flexibly deformable.

The first traction bands 18 are formed of an substantially belt-shaped fabric, etc., that extends up-down, and are arranged so as to cover the front of the user's thighs when the walking movement aid 10 is being worn. The material of the first traction bands 18 may be made of a thin, soft, deformable material, and woven fabric or non-woven fabric as well as leather, a rubber sheet, or a resin sheet, etc., may be suitably adopted in consideration of its feel, durability, breathability, etc. While the first traction bands 18 especially in this embodiment are made elastically deformable in the length direction (the up-down direction in FIG. 1), which is the direction of exertion of the pulling force by the electric motors 40 (described later), there is minimal elasticity in the width direction (the left-right direction in FIG. 1) so that deformation is restricted, and there is an anisotropic amount of deformation in regard to an input in the length direction and the width direction. In addition, it is preferable for the first traction bands 18 to have at least 0.3 $kgf/cm^2$ and 0.5 $kgf/cm^2$ or less of elasticity in the length direction.

Moreover, the ring-shaped connecting fittings 22 are attached to the upper ends of the first traction bands 18, and the first traction bands 18 are connected to the second traction bands 20 through the connecting fittings 22. The second traction bands 20 are belt-shaped with a substantially fixed width and are formed in that shape from fabric or leather, etc., using fiber with minimal elasticity. The auxiliary force transmission bands 12 are formed by inserting the intermediate portion of the second traction bands 20 into the connecting fittings 22, and thus connecting them to the first traction bands 18. The second traction bands 20 do not necessarily need to be something that can suppress elasticity, but it is preferable that at least one of first traction band 18 and the second traction band 20 is made of something with elasticity that is made of elastic fiber, etc., and allows elastic deformation in the length direction like that mentioned above in order to improve comfort by easing the impact of the auxiliary force and in order not to excessively hinder the user's self-consciousness movement.

The first wearing parts 14 are integrally provided on the lower portion of the first traction bands 18 of the auxiliary force transmission bands 12. In this embodiment, the first wearing parts 14 are given the shape of a sports supporter that is used in order to protect the knee joint and are, for example, formed of a fabric, etc., that has elasticity, they are wrapped around the user's knee joint and are attached with a hook-and-loop fastener or snaps, hooks, etc. In addition, the first wearing parts 14 may be formed independently of the first traction bands 18, and may be attached later by adhesion or stitches, etc. It is also preferable to consider forming through holes 24 on the first wearing parts 14 and positioning them at the user's kneecaps so as not to prevent bending and stretching of the knee joint.

The second wearing part 16 is attached to both ends of the second traction bands 20 of the auxiliary force transmission bands 12. The second wearing part 16 is composed of the transmission band support belt 26 and the drive device support belt 28 that are each worn around the lumbar, with the one end of the second traction band 20 attached to the transmission band support belt 26 and the other end attached to the drive device support belt 28.

The transmission band support belt 26 is formed of a belt-shaped fabric of minimal elasticity, it is wrapped around the user's lumbar and is worn on the lumbar by connecting both ends with a hook-and-loop fastener, snaps, hooks, etc. A ring-shaped pair of guide fittings 30 are provided on the transmission band support belt 26 and, with the transmission band support belt 26 worn on the lumbar, they are arranged on each of the left-right sides of the lumbar. One end of the second traction bands 20 can be attached to the front surface of the transmission band support belt 26 using such means as stitches, welding, snaps, hooks or a hook-and-loop fastener.

Figure 4:
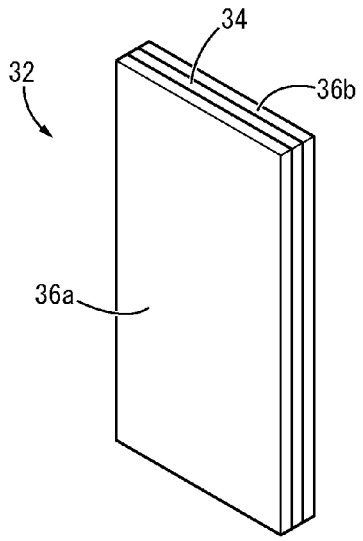
FIG. 4 is a perspective view of a capacitance type sensor constituting the walking movement aid shown in FIG. 1.

A left and right pair of the capacitance type sensors 32 are attached to the transmission band support belt 26 and extends downward as joint angle sensors that detect the angle of the user's hip joint in the front-back direction. These capacitance type sensors 32, for example, as shown in U.S. Pat. No. 7,958,789 and U.S. Pat. No. 8,451,011 etc., are flexible, variable capacitance type sensors that are allowed elastic deformation and, as shown in FIG. 4, have a structure wherein a pair of electrode membranes 36*a* and 36*b* formed of a conductive elastic material are provided on both surfaces of a dielectric layer 34, which is formed of a dielectric elastic material.

These capacitance type sensors 32 are positioned on both sides sandwiching the hip joints, they extend from the lumbar to the thighs, and are arranged so as to overlay and extend along the side surface of the body. In this embodiment, the upper end of the capacitance type sensor 32 is supported by being attached to the transmission band support belt 26, while the bottom end of the capacitance type sensor 32 is attached to a belt 37 that is worn wrapped around the thigh with a hook-and-loop fastener, etc.

When the transmission band support belt 26 is being worn, the capacitance type sensors 32 detect any deviation in application pressure caused by the bending and stretching of the hip joint as a change in capacitance accompanying the approach or separation of the pair of electrode membranes 36*a* and 36*b*, and that detection signal is input into the control device (46: described later) for a drive device 38 (described later). In addition, the capacitance type sensors 32 are worn so as to overlay along the respective right and left side surfaces of the user's body, and individually detect the incline angle (angle of the hip joint) of the left femur joint in the front-back direction in relation to the hip bone and the incline angle (angle of the hip joint) of the right femur joint in the front-back direction in relation to the hip bone.

These changes in the angles of the hip joint can be detected much more correctly by, for example, detecting the state of the surface pressure distribution of the capacitance type sensors 32. Concretely, with the capacitance type sensors 32 each arranged to extend along on the surface of the right and left side of the user's body, extending in an up-down direction and thus sandwiching the hip joints, if the femur is bent forward in relation to the hip bone by swinging one leg forward when the user is walking, the capacitance type sensor 32 undergoes pulling deformation in the area that is located more toward the back than the center of the body side and undergoes compression curve deformation in the area that is located more toward the front than the center of the body side. On the other hand, if the leg is kicked backward, the femur is bent backward in relation to the hip bone, the capacitance type sensor 32 undergoes pulling deformation in the area that is located more toward the front than the center of the body side and undergoes compression curve deformation in the area that is located more toward the back than the center of the body side. Therefore, each capacitance type sensor 32 determines in which area of the front or back that sandwich the center line of the body side pulling deformation has occurred and compression deformation has occurred in the other area based on the detection value for each of those areas, and it becomes possible to acquire the amount of the change in the angle of the hip joint based on the size of the detection value according to the degree of each deformation.

Especially because the capacitance type sensors 32 like those used in this embodiment are given, as described in U.S. Pat. No. 7,958,789 and U.S. Pat. No. 8,451,011, a thin, soft, easily deformable sheet structure, they do not give the user an excessive feeling of discomfort or restrict the user's autonomous body movement even when worn along the body surface.

Meanwhile, as shown in FIGS. 1 to 3, the drive device support belt 28 is formed of a belt-shaped fabric etc. of minimal elasticity, like the transmission band support belt 26, and is worn on the user's lumbar by wrapping it around the user's lumbar and connecting both ends with a hook-and-loop fastener or snaps, hooks, etc. Moreover, the rear portion of the drive device support belt 28 extends further downward than the front portion, giving it a larger surface area, and drive device 38 is installed on that rear portion.

Figure 5:
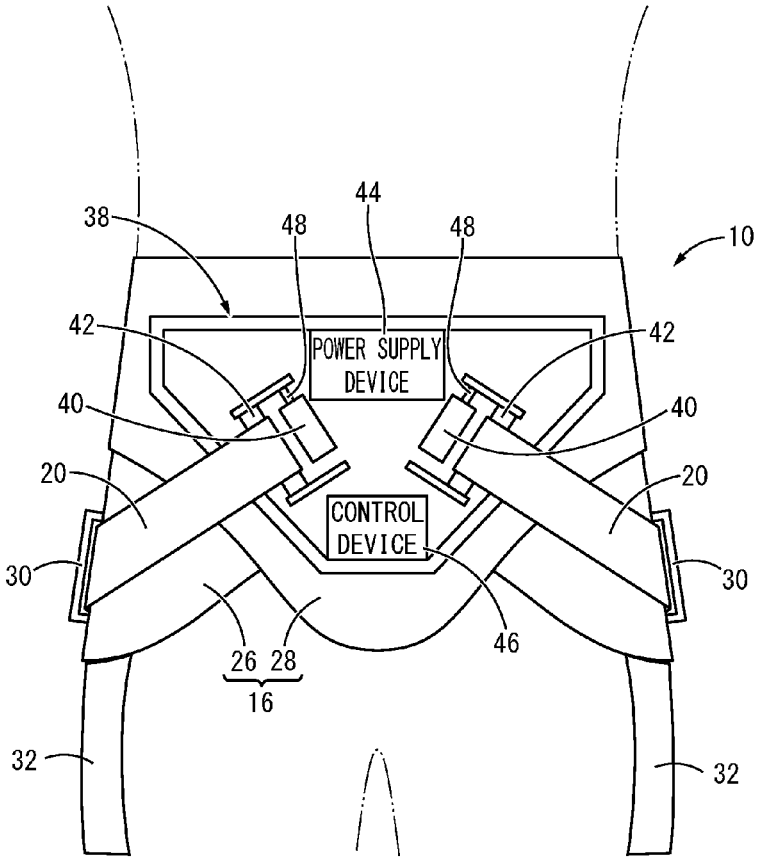
FIG. 5 is a diagram that displays an internal structure of a drive device with a cover off, in the rear view of the walking movement aid shown in FIG. 2.

As shown in FIG. 5, drive device 38 is composed of a left and right pair of electric motors 40 as the drive sources, a left and right pair of rotation shafts 42 that are rotary driven by that pair of electric motors 40, a power supply device 44, such as batteries, which supplies electrical power to the electric motors 40, and a control device 46 that operates the electric motors 40 based on the detection result in the capacitance type sensors 32.

Each electric motor 40 is a common electric device and preferably employs a servo motor, etc., which can detect the rotational position and can control the amount of rotation in both the forward and reverse directions. The rotating drive force of drive shafts 48 for the electric motors 40 that are driven by the electricity supplied from the power supply device 44 is transmitted to the rotation shafts 42 via a suitable reduction gear train. The rotation shafts 42 are supported, rod-shaped components that are allowed to rotate in the circumferential direction, and the other end of the second traction bands 20 is fixed and wound around their outer peripheral surface. As the other end of the second traction bands 20 is attached the drive device support belt 28 via drive device 38, the auxiliary force transmission bands 12 are thereby arranged to cross over the hip joints.

The second traction bands 20 of the auxiliary force transmission bands 12 are wound onto the rotation shafts 42 by the rotation shafts 42 being turned in one circumferential direction through the driving force exerted from the drive shafts 48 for the electric motors 40. Through this, the driving force from the electric motors 40 is transmitted in the length direction of the auxiliary force transmission band 12 (the length direction of the first traction bands 18 and the second traction bands 20) and is exerted between the first wearing parts 14 and the second wearing part 16 as a pulling force. As is clear from the above, the auxiliary force transmission bands 12 extend in the direction that the driving force of the electric motors 40 is transmitted. If, on the other hand, the rotation shafts 42 are rotated by the electric motors 40 in the other circumferential direction, the winding of the auxiliary force transmission bands 12 by the rotation shafts 42 is canceled and they are unwound, and the pulling force between the first wearing parts 14 and the second wearing part 16 is released.

Reverse rotation of the electric motors 40, however, is not absolutely necessary, and the pulling force between the first wearing parts 14 and the second wearing part 16 may be canceled by simply stopping the electric supply to the electric motors 40 and allowing the auxiliary force transmission bands 12 to freely unwind. In this way, it becomes possible to easily follow walking movement in accordance with movement based on the user's muscular strength without excessive slackening of the auxiliary force transmission bands 12 and without tensile force to the extent that it becomes a resistance to that movement.

The control of the electric motors 40 is performed by the turning the supply of electricity from the power supply device 44 to the electric motors 40 on and off and by the current direction (the rotational direction of the drive shafts 48) being controlled by the control device 46. The control device 46 detects the bending movement and extension movement of the user's hip joints based on the detection result (output signal) in the capacitance type sensors 32, and controls the supply of electricity to the electric motors 40 according to the detected movement of those hip joints. Due to this, the pulling force exerted between the first wearing parts 14 and the second wearing part 16 is adjusted by the control device 46 based on the driving force of the electric motors 40. In addition, in this embodiment, the control device 46 specifies the stage of walking movement (for example, the specified hip joint angle, such as the stage of bending the hip joint and swinging the rear leg forward, or the stage of extending the hip joint and kicking the ground with the front foot), and controls the supply of electricity to the electric motors 40 according to the hip joint angle that is at the specified stage of walking movement.

Figure 6:
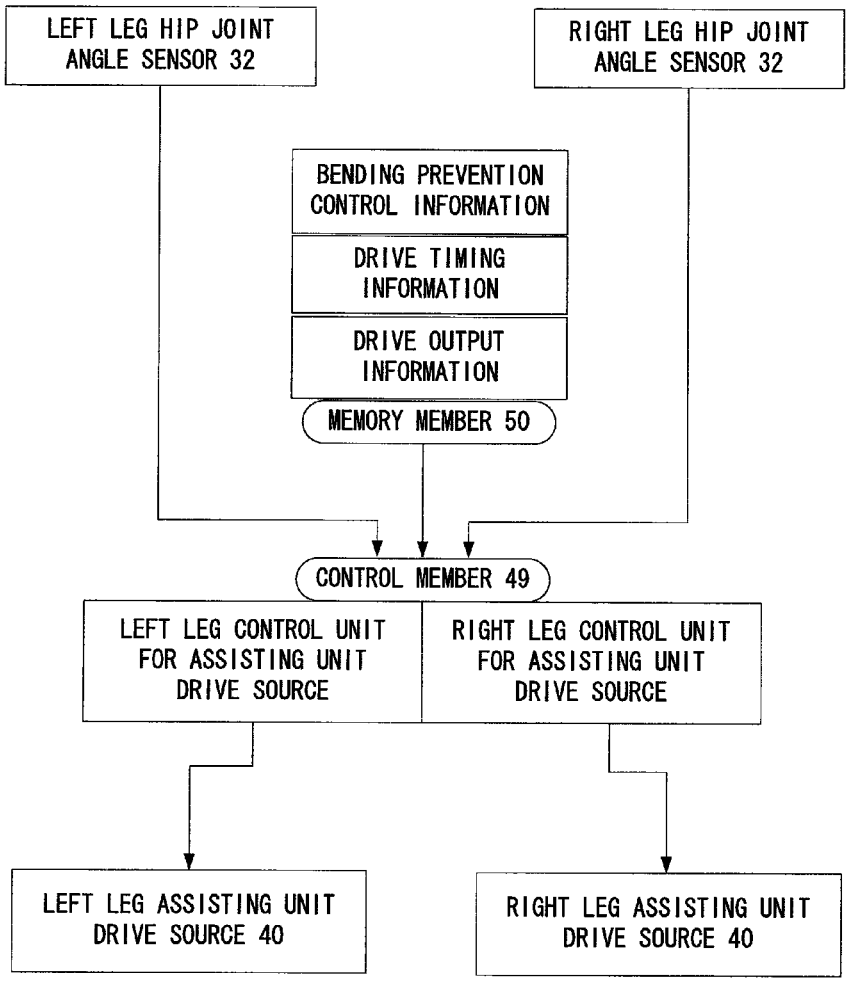
FIG. 6 is a functional block diagram of a control system in the walking movement aid shown in FIG. 1.

In other words, a control member 49 for the electric motors 40 with the control device 46 uses the detected angle of the hip joints on both sides as a reference signal and turns on the supply of electricity from the power supply device 44 to the electric motors 40 in order to meet the control conditions of the electric motors 40 for the preset, specified stage of the hip joint angles. Concretely, for example, as show in the functional block diagram in FIG. 6, the control member 49 is composed of a memory member 50, like RAM, etc., which stores the control information including the drive timing information that specifies the timing at which electric power supply is turned on and off to the electric motors 40 corresponding to a change in the hip joint angles, and the drive output information that specifies the amount of electric power to be supplied to the electric motors 40 (the amount that the auxiliary force transmission bands 12 are wound up in response to the support force). The drive timing information and drive output information stored in the memory member 50 can be changed as necessary. For example, it is possible to adjust the angular position of the hip joints at which the support force is demonstrated, and the amount of the support force that is exerted for each user.

And, according to the program stored in advance in the ROM or RAM of the memory member 50, the control section of the control member 49 outputs a drive control signal in order to turn the supply of electricity on or off from the power supply device 44 to the electric motors 40 of the assisting unit based on the drive timing information and drive output information which were stored in advance in the memory member 50 when the hip joint angle reaches the angle that is stored in advance in the memory member 50 to start or stop the supply of electricity, with the hip joint angle that is output from the capacitance type sensors 32, serving as angle sensors on both hip joints, as the reference signal. In this embodiment, a pair of independent capacitance type sensors 32, the control section in the control member 49, and the electric motors 40 for driving the assisting unit all are respectively provided on the left and right sides and, based on the control information in the memory member 50, the control of the supply of electricity to the electric motors 40 by the control member 49 is implemented separately for each left and right leg. In short, the drive control signals in the control member 49 that control the electric motors 40 in the left and right pair of assisting units are output independently from each other to the left and right leg.

Furthermore, the information for changing the electrical power that is supplied to the electric motors 40 corresponding to the range of the hip joint angle (the coefficient that is multiplying the initial value of the amount of winding) may be included as the drive output information stored in the memory member 50. Through this, for example, whenever the hip joint angle reaches an angle at preset multiple stages, it is possible to increase or decrease in stages or gradually the output of the electric motors 40, or to further increase the efficiency of the assistance force exerted on the user during walking, and achieve further mitigation of any discomfort to the user.

Incidentally, a change in muscular strength is produced during walking in each region of the lower-limb muscles of a non-handicapped person, in the gluteus maximus, the biceps femoris, the tibialis anterior muscle, the rectus femoris, and the calf muscles. For example, it is known that the production of muscular strength that changes in peaks over time in response to the changes in the angles of the hip joints is repeatedly generated in each lower-limb muscle in the walking cycle. Therefore, we can understand that, with the walking movement aid 10 of this embodiment, exertion of the support force on the lower-limb muscles according to the hip joint angles becomes as if artificial muscles are additionally provided and it is possible to assist muscular strength during walking.

Figure 7:
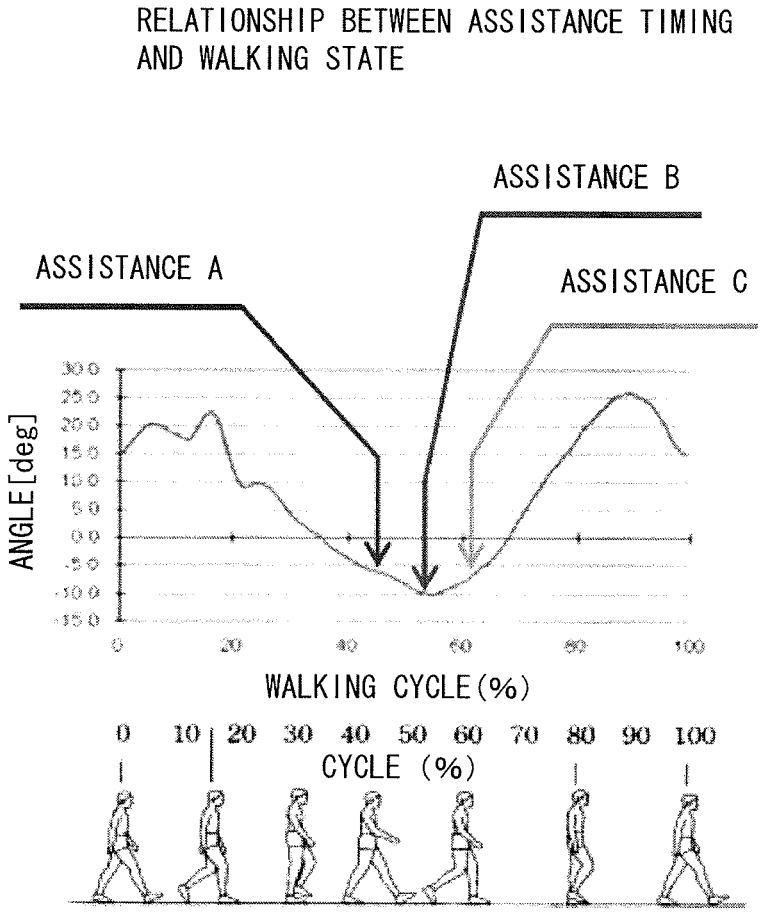
FIG. 7 is a diagram suitable for explaining the relationship between the action time of the support force of the walking movement aid of this invention and the hip joint angles.

Moreover, when a non-handicapped person walked and changes in the angles of their hip joints were detected based on the output value of the capacitance type sensors 32 like mentioned above, the detection of a periodic hip joint pattern change was confirmed with practical accuracy as shown in FIG. 7. Therefore, it can be thought that, by controlling the start and stop, etc., of the supply of electricity to the electric motors 40 at the predetermined timing that was specified in advance and based on the detection signal of those capacitance type sensors 32, an assistance effect to muscular strength in walking is demonstrated like mentioned above. Because the width of the change in the angles of the hip joints when walking and the relative relationship between the phase of the hip joints and the generated muscular strength of each muscle differ depending on the user's individual physique, manner of walking, and personal habits, etc., it is preferable to change the concrete setting for whether to start or stop, etc., the supply of electricity to the electric motors 40 for each user, for example, at either point indicated as assist A, B or C in FIG. 7. At that time, whether that set point suits the user or not is determined by referring the user's subjective opinion, or determined, for example, based on the suitability determination result, etc. of the support effect that is acquired by carrying out a relative comparison of the output value of the user's muscle electric potential sensor that is actually measured by changing the point where the electric supply to the electric motors 40 starts and stops.

Figure 8:
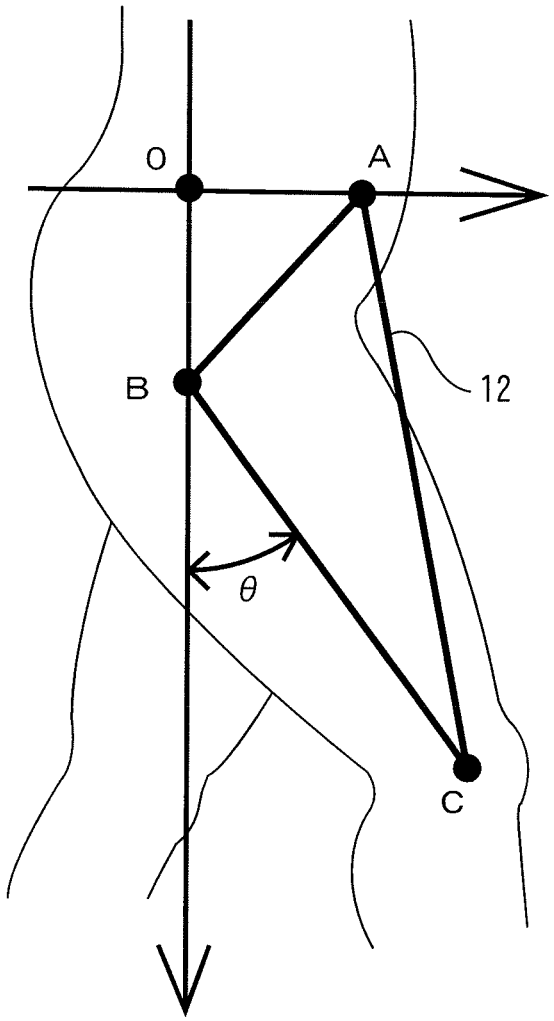
FIG. 8 is a diagram suitable for explaining changes in an effective free length of an auxiliary force transmission band of the walking movement aid shown in FIG. 1 accompanying walking movement.

Incidentally, if, as shown in model form in FIG. 8, the position of the upper ends of the auxiliary force transmission bands 12 worn on the user is taken as fulcrum A, the hip joint position of the user as fulcrum B, and the position of the lower ends of the auxiliary force transmission bands 12 worn on the user is taken as fulcrum C, then the length of side AC of a triangle ABC relative to the length of the auxiliary force transmission bands 12 changes according to hip joint angle θ. In addition, point O in FIG. 8 is the intersection of the horizontal line that passes through fulcrum A and the vertical line that passes through fulcrum B. Moreover, the position of fulcrum A is substantially the center position between the attachment position of one end of the second traction bands 20 to the transmission band support belt 26 and the guide fittings 30 into which those second traction bands 20 are inserted.

Figure 9:
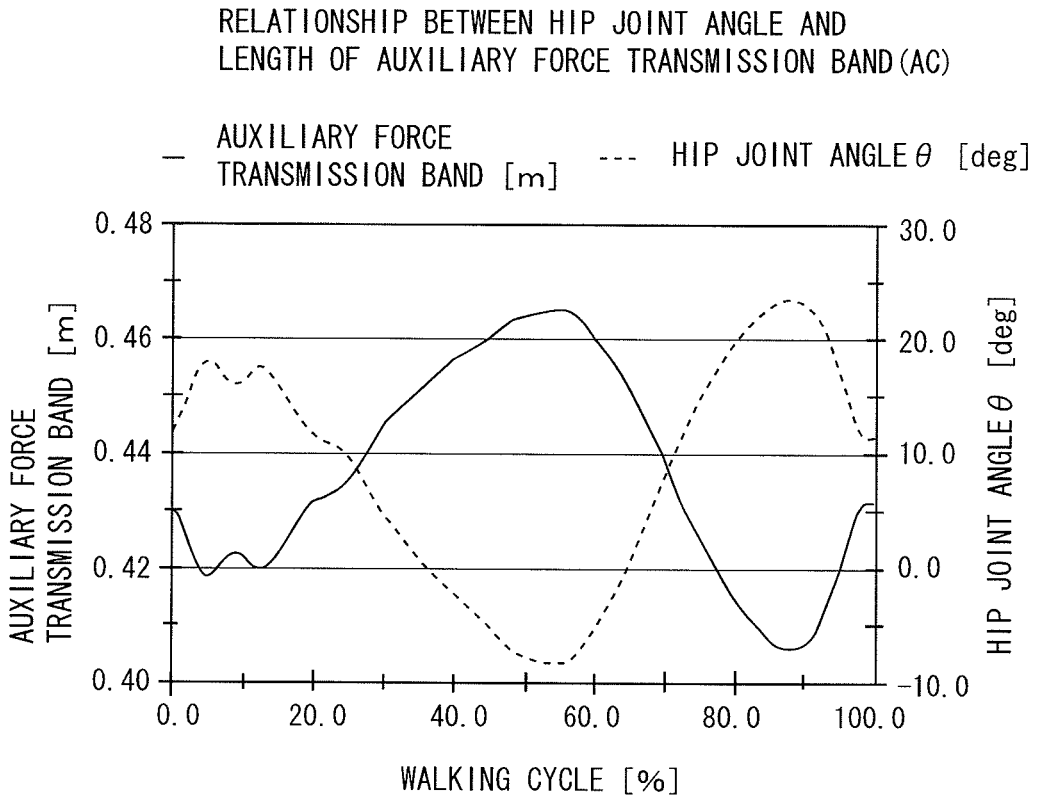
FIG. 9 is a diagram that includes a relational expression to explain the relationship of the effective free length of the auxiliary force transmission band shown in FIG. 8 to the hip joint angles.

Here, as shown in FIG. 9, the length of the auxiliary force transmission bands 12 (the length of side AC) as that effective length changes cyclically according to hip joint angle θ during walking, and that concrete length can be found with the expression in FIG. 9. In this embodiment, by forward and reverse rotational control of the electric motors 40 such that the length of the auxiliary force transmission bands 12 changes only by amounts that are equivalent to the difference between side AC that is calculated based on this expression and the standard length without bending of side AC at the predetermined point of the walking cycle, the tensile force that acts on the auxiliary force transmission bands 12 during walking is maintained substantially constant (for example, substantially ±0), and bending is prevented.

Figure 10:
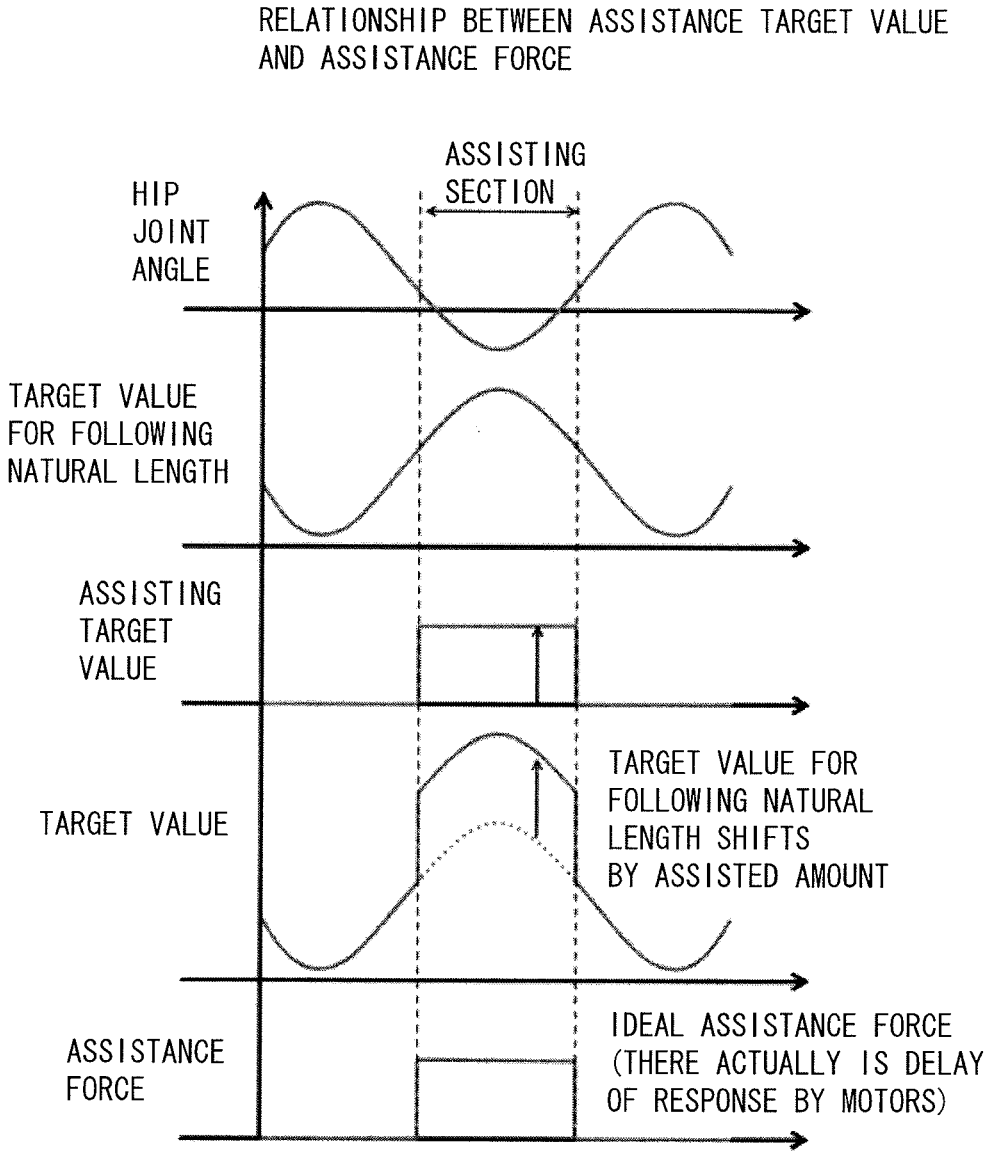
FIG. 10 is a diagram suitable for explaining the relationship between the support (assistance) force control and the response control for a change in the effective free length of the auxiliary force transmission bands in the walking movement aid shown in FIG. 1.

The bending prevention control from such tensile force adjustment of the auxiliary force transmission bands 12 is realized by rotating the electric motors 40 according to the hip joint angle θ during walking based on the relational expression stored in advance and by adjusting the amount of winding up and the amount of unwinding of the second traction bands 20. Concretely, for example as show in the functional block diagram in FIG. 6, this bending prevention control system is composed of the memory member 50, like RAM, etc., which stores the bending prevention control information that includes the coefficient of the above-mentioned expression that calculates the length of the auxiliary force transmission bands 12 (the length of side AC) based on a change in the hip joint angles, the standard length of the auxiliary force transmission bands 12 at the predetermined point of the walking cycle, the rotational direction of the electric motors 40 corresponding to the amount of winding up and the amount of unwinding of the second traction bands 20, and the drive timing information that specifies the timing at which electric power supply is turned on and off. Furthermore, the drive timing information stored in the memory member 50 can be changed as necessary, for example, it can be adjusted according to the physique of each user. And, as shown in FIG. 10, this bending prevention control can be performed independently from the support force control that corresponds to the above-mentioned hip joint angles. A drive control signal can also be output by the control member 49 to perform drive control of the electric motors 40 to ensure that both controls are overlapped and the target value of both controls is attained overlapping. Through this kind of bending prevention control, because the effective length of the auxiliary force transmission bands 12 is made to follow and change according to the change in the angles of the hip joints, and the auxiliary force transmission bands 12 are maintained in an extended state of a substantially fixed tensile force, it becomes possible to exert the target support force on the user's leg stably and with good accuracy when the electric motors 40 are driven based on the support force control, without almost any adverse effects by the change in the length of the auxiliary force transmission bands 12 according to a change in the hip joint angles.

When the walking movement aid 10 that is structured in this way is worn, an auxiliary force (assistance force) is exerted in order to reinforce the required strength in the bending movement of the hip joints when the hip joints are being bent, and it becomes possible to assist the movement that is accompanied by bending and stretching of hip joints. In other words, if it is determined that the user is trying to bend his or her hip joint based on the detection result in the capacitance type sensors 32, the control device 46 supplies electricity to the electric motor 40 from the power supply device 44 and turns the rotation shaft 42 in one circumferential direction. Through this, because the second traction band 20 is wound onto the rotation shaft 42, thus shortening the substantial length of the second traction band 20, the connecting fitting 22 fitted externally onto the middle of the second traction bands 20 is displaced and pulled toward the second wearing part 16 side (upper side), so that the length of the auxiliary force transmission band 12 is shortened. And, through the first traction band 18 that is attached to the connecting fitting 22, a pulling force is exerted on the first wearing part 14, pulling the first wearing part 14, which is attached the knee joint, toward the second wearing part 16 that is attached to the lumbar. The result is that an assistance force acts so that the knee joint can resist gravity and be drawn toward the lumbar and it assists the muscular strength that is involved in the walking movement that is accompanied by bending of the hip joints. In addition, if the torque of the rotation shafts 42 (supply voltage to the electric motors 40) is adjusted by the control device 46 according to a change in the hip joint angle θ value detected by the capacitance type sensors 32, it will become possible to even more efficiently provide, without excess or shortage, the assistance force to the movement that the user is trying to perform. Moreover, user discomfort due to excessive supplement to or restriction of the hip joint movement can be avoided by stopping the electricity to the electric motors 40 when the value of hip joint angle θ reaches the value established in advance.

On the other hand, if, based on the detection result in the capacitance type sensors 32, it is determined that the user is trying to extend his or her hip joint, the control device 46 supplies electricity to the electric motor 40 from the power supply device 44 and turns the rotation shaft 42 in the other circumferential direction. Through this, because the second traction band 20 is unwound from the rotation shaft 42, thus lengthening the substantial length of the second traction band 20, the connecting fitting 22 fitted externally onto the middle of the second traction band 20 is displaced in the direction away from the second wearing part 16 side (lower side) through its own weight and elasticity, etc. And, because the pulling force that is exerted on the first wearing parts 14 through the first traction band 18 that is attached to the connecting fitting 22 is released, it prevents the walking movement aid 10 from hindering the extension movement of that hip joint.

Thus, when the walking movement aid is worn, because a portion of the strength needed when bending the hip joints is supplemented by the generating force of the electric motors 40, it is possible to perform the target movement with minimal muscular strength, for example, when performing the movement of bending the hip joint to bring the back leg forward when walking. By using the walking movement aid 10, even if the user does not have sufficient muscular strength to perform movement due to aging, illness or injury, the target movement can be performed smoothly and it becomes possible to prevent restrictions in user activity.

Moreover, the first traction bands 18 of the auxiliary force transmission bands 12 are provided on the path on which the generating driving force of the electric motors 40 is transmitted to the user's legs as an assistance force and are made elastically deformable in the direction that the force is transmitted. Due to that, the generating driving force of the electric motors 40 is only exerted on the user's legs after being eased by the elastic deformation of the first traction bands 18. Thus, in comparison with when the generating driving force of the electric motors 40 is transmitted directly, the load on the user's joints, etc., can be mitigated and it can prevent the problem of muscular pain, etc. Especially with this embodiment, it is preferable to make the assistance force exerted on the user's legs a comparatively small force of about 2 kgf to 5 kgf. In this way, movement is not forcibly imposed on the user, the action of only a support force that is based on the idea of compensating for insufficient muscular strength that is necessary for movement is realized, and it becomes possible to perform the necessary assistance without applying a load on the user's body.

Figure 11:
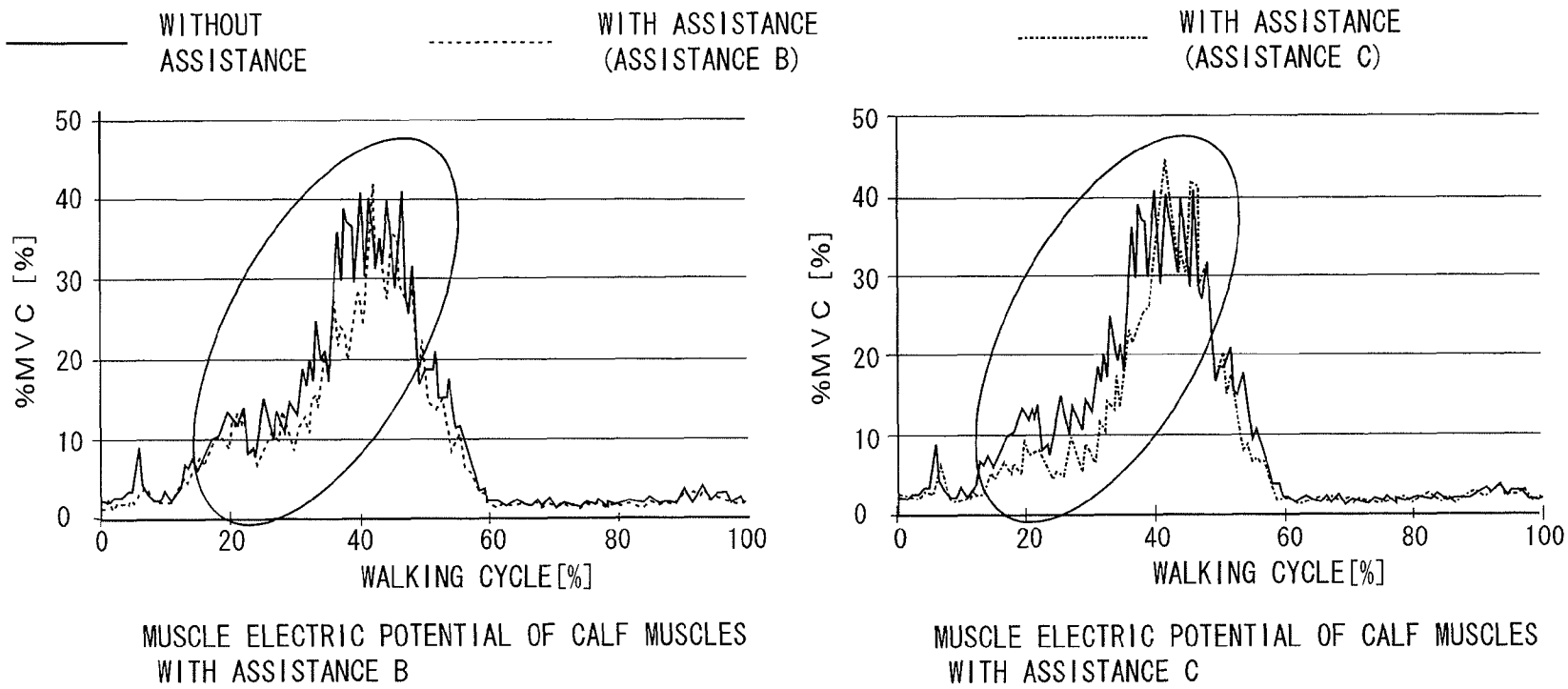
FIG. 11 is a graph that displays the results of experiments that confirm the effect of the muscular strength support (assistance) by the walking movement aid shown in FIG. 1.

Incidentally, an experiment was conducted wherein a non-handicapped person actually wore the walking movement aid 10 made into the structure according to this embodiment and its support effect was checked during walking. In that experiment, a muscle electric potential sensor was worn on the surface of the calf muscles, and the muscle electric potential detection waveform was compared when a support force was applied, i.e., there was assistance, and when a support force was not applied, i.e., there was no assistance. The result is shown in FIG. 11. The tests were performed with the timing of the start of the support force action set to point B and point C in the above-mentioned FIG. 7 each established and the hip joint angle θ as the reference signal. As shown in FIG. 11, it was confirmed that exerting a support force decreases the muscle electric potential in the range of 20 to 40% of the walking cycle, and an effective support effect was demonstrated.

Furthermore, because the auxiliary force transmission bands 12 are made elastic and deformable, thus allowing the user's autonomous and instantaneous movement, fall-preventing movement can be realized especially in the case of a disturbance input when pushed from the transverse direction, without an excessive sense of restriction to the user like with the conventional external skeleton type of auxiliary force-transmitting device.

In addition, toward the purpose of reducing restriction on the user while avoiding any shock effect from the support force, it is preferable for the elasticity in the direction that the force of the first traction bands 18 is transmitted to be set to between 0.3 kgf/cm$^2$ and 0.5 kgf/cm$^2$. Through that, the generating driving force of the electric motors 40 is sufficiently buffered, thus enabling any excessive load acting on the leg of user to be avoided, only enough effective assistance force to sufficiently allow the user's autonomous movement is transmitted to the user's legs, and movement can be effectively assisted.

Deformation of the first traction bands 18 is also restricted in the direction substantially orthogonal to the direction in which the force is transmitted, elasticity in the circumferential direction (diameter expansion deformation and diameter contraction deformation) of the first wearing parts 14 integrally formed with the first traction bands 18 is suppressed, and the stability of shape is improved. The first wearing parts 14 are, thereby, held without separating from the knee joint at the time of pulling force action by the electric motors 40, and assistance force is effectively transmitted to the legs.

Moreover, while the assistance force through the walking movement aid 10 is demonstrated during the bending movement of the hip joint, it is canceled during the extension movement of the hip joint. Through this, wearing the walking movement aid 10 assists bending movement of the hip joint, which requires movement that resists gravity when standing, and avoids the assistance force acting as resistance in hip joint extension movement that is aided by the action of gravity when standing, and smooth movement is thereby realized. Thus, even in walking movement, etc., which is performed by the repeated bending and expansion of the hip joints, the necessary assistance force can be provided at the opportune time and movement can be appropriately assisted.

With the walking movement aid 10 of this embodiment, because such generation of an assistance force according to the state of movement of the user is automatically performed by the control device 46 based on the result of the detection of the hip joint angle by the capacitance type sensors 32 and referring to the control signal stored in the memory member 50, troublesome user operation becomes unnecessary. Moreover, in this embodiment, because the control of the support force for muscular strength on either the left or right leg is performed separately and independent based on those left and right hip joint angles, it become easy to control the demonstration of a large support force based on the detection value of the hip joint angle of that one leg, etc., even in cases such as when the hip joint angle of only one leg changes greatly, like when tripping on something, etc.

Moreover, because the capacitance type sensors 32 are adopted in this embodiment, the drop in detection accuracy due to temperature change is small and compensation to temperature change is also easy. Therefore, correct detection results can be stably obtained, for example, even when there is a large temperature change caused by the change in the user's body temperature accompanying walking movement, etc. In addition, because the drop in detection accuracy with repeated input is also small with the capacitance type sensors 32, sufficient durability can be secured and regular use in daily life, etc., becomes possible with high precision.

And, because the auxiliary force transmission part in this embodiment is composed of the auxiliary force transmission bands 12, which are formed of a thin, belt-shaped fabric, sufficient flexibility is given and the device can be easily put on and taken off in comparison with the walking movement aids with a rigid external skeleton. In other words, when the user wears a rigid external skeleton, it is necessary for that user to adjust the bending angle of their joints in accordance with the form of that external skeleton, and it is often difficult to wear sitting down. However, with the walking movement aid 10 in this embodiment, because the auxiliary force transmission bands 12 that connect the first wearing parts 14 and the second wearing part 16 are flexible and bend as necessary, it is possible to attach the first wearing parts 14 and the second wearing part 16 at respectively appropriate positions if the auxiliary force transmission bands 12 are sufficiently lengthened, no matter what degree the bending angle of the user's joints is. Moreover, by making the auxiliary force transmission bands 12 flexible, the first wearing parts 14 and the second wearing parts 16 can each be worn, for example, in a seated posture with the hip joints bent, and the work of putting on and taking off the device can be accomplished in an convenience posture.

By furthermore adopting the auxiliary force transmission bands 12 formed of a thin, belt-shaped fabric, the walking movement aid 10 is made lightweight so that elderly people whose muscular strength has declined can also handle it easily. And, in this embodiment, since the first wearing parts 14 and the second wearing part 16 are each made of fabric, the walking movement aid 10 is lightened even more overall, thus achieving further improvement in manageability, including work of putting it on and taking it off, etc.

Additionally, by making the auxiliary force transmission bands 12 of thin fabric, the auxiliary force transmission bands 12 are arranged to fit the form of the user's body surface when worn and they curve easily in the direction of thickness along the body surface. So, it is possible for the walking movement aid 10 to be used freely in daily life, such as wearing clothes over it without it being conspicuous.

By also attaching the first wearing parts 14 to the knee joint and attaching the second wearing part 16 to the lumbar, the length of the auxiliary force transmission bands 12 is prevented from becoming longer than necessary, the miniaturization of the walking movement aid 10 is achieved, and the assistance force is efficiently exerted to the leg. Basically, that is because the support force from the pulling force acts more efficiently on the leg if the separation from the hip joint, which is the fulcrum (fulcrum B in FIG. 8) when swinging the thigh to the points of action, i.e., the first and second wearing parts 14, 16 (respectively, fulcrum C, A in FIG. 8), is enlarged. Moreover, in this embodiment, because at least a part of the auxiliary force transmission bands 12 are elastic, the length (side AC in FIG. 8) of the auxiliary force transmission bands 12 can be increased without changing the separation from the hip joint, which is the fulcrum to the points of action, i.e., the first and second wearing parts 14, 16. Thus, in addition to the support force brought by the pulling force, an elasticity restoring force also acts efficiently on the leg. Furthermore, the drive device 38 can be kept from becoming a hindrance to walking movement by locating the drive device 38 on the lumbar which has small momentum during walking.

An embodiment of this invention is described in detail above, but this invention is not limited to this concrete description. For example, the first wearing parts may be worn on the thigh above the knee joint and thereby realizing further miniaturization of the device.

The location, etc., in which the control device 46 and the power supply device 44 are worn is not limited and, for example, they can be worn in such ways as being kept in the pocket of the user's clothes as an independent structure connected by a lead wire for power, or they can be slung on the user's shoulder.

Moreover, the joint angle sensors that detect the user's movement are not limited to the capacitance type sensors but, for example, resistance change sensors that detect the user's movement based instead on changes in the resistance due to the effect of force may also be adopted. Since measurement using direct voltage is possible, if this kind of resistance change sensor is adopted, simplification of the measurement circuit will become easier, and miniaturization as well as cost reduction will also be simplified. And, since resistance also changes sharply according the action of minimal force, it would become possible to detect a broad range of joint movement, from slight to large. In addition, the flexible device shown in U.S. Pat. No. 7,563,393 is suitably adopted as a resistance change sensor. Furthermore, a combination of multiple types of sensors with different structures and detection methods may also be used, such as a combination of the capacitance type sensors and resistance change sensors, etc.

Figure 12:
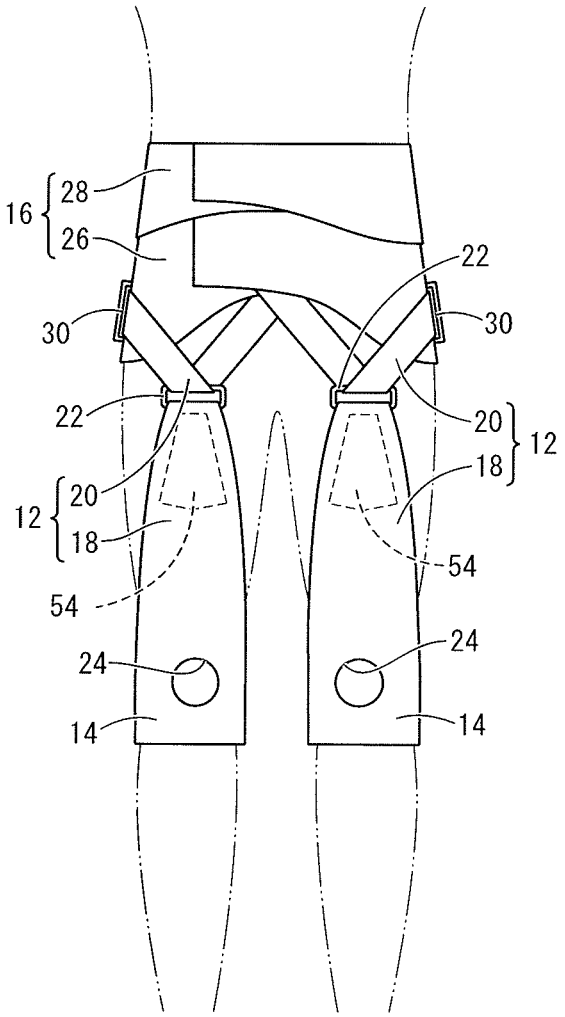
FIG. 12 is a front view of a different embodiment of the joint angle sensor of the walking movement aid shown in FIG. 1.
Figure 13:
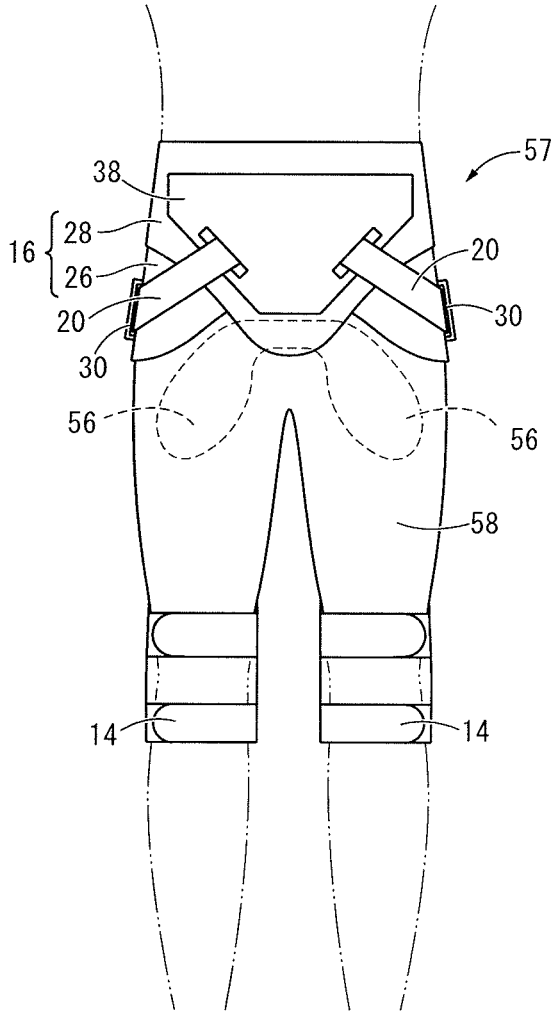
FIG. 13 is a front view of another different embodiment of the joint angle sensor of the walking movement aid shown in FIG. 1.

Also, for example, as shown in FIG. 12, by wearing capacitance type sensors 54 on the rear of the first traction bands 18 (the side contacting the thigh) and overlapping the front of the thigh, the clamping force between the first traction bands 18 and the thigh that accompanies deformation of the femoral muscle when the hip joint is bent can be detected as a change in capacitance. Or, for example as shown in FIG. 13, if capacitance type sensors 56 are adopted that spread out from the user's buttocks to the thigh, the bending and stretching of the hip joint can be detected more directly. In this case, in addition to the auxiliary force transmission bands 12 and the first and second wearing parts 14 and 16, a walking movement aid 57 includes a sensor holding suit 58 in the shape of trousers (or leggings), which is equipped with the capacitance type sensors 56, with the auxiliary force transmission bands 12 and the first and second wearing parts 14 and 16 worn after putting on the sensor holding suit 58. The capacitance type sensors 54 and 56 shown in FIGS. 12 and 13 can also employ a fundamental structure that is the same as the capacitance type sensors 32 shown in the above-described embodiment. Further, the capacitance type sensors 54 which are worn on the front of the thigh and the capacitance type sensors 56 which are worn on the surface of the buttocks as shown in FIGS. 12 and 13 can be attached on the surface of the user's body at both their top and bottom ends. Then, for example, by using the stress change that accompanies pulling deformation that occurs when the leg steps forward and easing of the pulling deformation when the leg is kicked out, it is also possible to detect the swinging angle of the hip joint in the front-back direction. Furthermore, a sensor that directly detects angles, such as a rotary encoder, can be adopted as the joint angle sensor to directly detect the hip joint angles.

The auxiliary force transmission parts are also not necessarily limited to being flexible overall; they may partially have rigid portions formed by metal, synthetic resin, etc. Also, the whole of the auxiliary force transmission parts may be made elastically deformable in the direction of the transmitted force, or the auxiliary force transmission parts may also be allowed elastic deformation partially in the direction of transmitted force.

With the walking movement aid in this invention, it is also possible to apply a resistance force to the user, i.e., the acting force in the direction of resistance to the force needed in walking movement assistance, in order to acquire a muscular strength training effect. Concretely, a drive control signal is output by the control member 49 so that, in the case where the extension of the hip joint is detected by the joint angle sensor, especially when the front leg is moved backward, a force is applied in the opposite direction to walking movement, i.e., moving the front leg forward. With the walking movement aid in this invention, this kind of resistance force is given to the user by the electric motors 40 winding up the auxiliary force transmission bands 12. Assistance force and resistance force may also be combined so that assistance force is exerted when moving one leg from back to front and resistance force is exerted when moving from front to back, with both being achieved by the electric motors 40 winding up the auxiliary force transmission bands 12. By providing the user with such resistance force, the load exerted on that user during walking can be made larger than usual, and, for example, the restoration of muscular strength can be promoted much more effectively in patients with reduced muscular strength. Furthermore, when restoration of muscular strength is confirmed, by increasing, in stages or gradually, the amount of electricity supplied in order to increase the load on the patient, the further restoration of muscular strength is promoted and an improvement in condition and prevention of locomotive syndrome, etc., can be expected.

What is claimed is:

1. A walking movement aid comprising:

a left and right pair of assisting units, each of the assisting units including an auxiliary force transmission part having flexibility, a first wearing part configured to be worn on a thigh side with respect to a user's hip joint, a second wearing part configured to be worn on a lumbar side with respect to the user's hip joint, and a drive source for applying a pulling force to the auxiliary force transmission part, the first wearing part and the second wearing part are disposed at opposite end parts of the auxiliary force transmission part;

a joint angle sensor for detecting a joint angle of a front-back direction of the user's hip joints;

a memory member for storing control information relating to drive timing information and drive output information for driving each drive source with the left and right pair of assisting units corresponding to changes in the joint angle with the user's hip joints; and a control member for performing drive control of each drive source with the left and right pair of assisting units based on the control information of the memory member.

2. The walking movement aid according to claim 1, wherein drive control signals by the control member are output independently from each other to the respective drive sources with the left and right pair of assisting units.

3. The walking movement aid according to claim 1, wherein the drive output information of the memory member comprises information that changes an output of the drive source corresponding to the changes in the joint angle.

4. The walking movement aid according to claim 1, wherein the memory member stores bending prevention control information to follow an effective length of the auxiliary force transmission part of the left and right pair of assisting units corresponding to changes in the joint angle of the user's hip joints, and the control member performs drive control of the respective drive sources of the left and right pair of assisting units so as to change the effective length and keep a fixed tensile force action state of the auxiliary force transmission part corresponding to changes in the joint angle based on the bending prevention control information stored in the memory member.

5. The walking movement aid according to claim 1, wherein the joint angle sensor comprises a sensor made to detect an incline angle in the front-back direction of a femur in relation to a hip bone of the user individually for the left and right leg.

6. The walking movement aid according to claim 1, wherein at least a portion of the auxiliary force transmission part is elastically deformable in a direction of exertion of the pulling force by the drive source.

* * * * *